US010378763B2

(12) United States Patent
Singh et al.

(10) Patent No.: US 10,378,763 B2
(45) Date of Patent: Aug. 13, 2019

(54) METHOD AND APPARATUS TO FACILITATE HEATING FEEDWATER IN A POWER GENERATION SYSTEM

(71) Applicant: General Electric Company, Schenectady, NY (US)

(72) Inventors: Surinder Prabhjot Singh, Niskayuna, NY (US); Dan Hancu, Clifton Park, NY (US); Benjamin Rue Wood, Niskayuna, NY (US); Wei Chen, Clifton Park, NY (US); Dwayne David McDuffie, Niskayuna, NY (US); Mark David Kehmna, Glenville, NY (US); Irina Pavlovna Spiry, Glenville, NY (US)

(73) Assignee: General Electric Company, Schenectady, NY (US)

( * ) Notice: Subject to any disclaimer, the term of this patent is extended or adjusted under 35 U.S.C. 154(b) by 5 days.

(21) Appl. No.: 14/957,738

(22) Filed: Dec. 3, 2015

(65) Prior Publication Data

US 2017/0159932 A1 Jun. 8, 2017

(51) Int. Cl.

| | |
|---|---|
| ***F22D 1/00*** | (2006.01) |
| ***F22B 1/16*** | (2006.01) |
| ***F23J 15/04*** | (2006.01) |

(52) U.S. Cl.

CPC ..... *F23J 15/04* (2013.01); *F22B 1/16* (2013.01); *F22D 1/003* (2013.01); *F23J 2215/50* (2013.01)

(58) Field of Classification Search

CPC . F22D 1/003; F22D 1/16; Y02C 10/06; F22B 1/16

See application file for complete search history.

(56) References Cited

U.S. PATENT DOCUMENTS

| | | | |
|---|---|---|---|
| 2,653,447 | A | 9/1953 | Heller |
| 4,582,122 | A | 4/1986 | Fan |

(Continued)

FOREIGN PATENT DOCUMENTS

| | | | |
|---|---|---|---|
| CN | 201764527 | U | 3/2011 |
| CN | 202733874 | U | 2/2013 |
| CN | 202769692 | U | 3/2013 |

OTHER PUBLICATIONS

Merkel et al., "Power plant post-combustion carbon dioxide capture: An opportunity for membranes", Journal of Membrane Science, Science direct, vol. 359, Issues 1-2, pp. 126-139, Sep. 1, 2010.

(Continued)

*Primary Examiner* — Audrey K Bradley

(74) *Attorney, Agent, or Firm* — Baker Hughes Patent Oganization

(57) ABSTRACT

A power generation system includes a power generation plant portion including a feedwater heating system configured to channel a feedwater stream and a carbon dioxide capture portion coupled in flow communication with the power generation plant portion. The carbon dioxide capture portion includes a solvent circuit configured to channel a solvent stream through at least a portion of the carbon dioxide capture portion. The carbon dioxide capture portion also includes a heat recovery system coupled in flow communication with the solvent circuit and the feedwater heating system. The heat recovery system is configured to transfer heat energy from the solvent stream to the feedwater stream and to channel the heated feedwater from the heat recovery system to the feedwater heating system.

12 Claims, 2 Drawing Sheets

(56) References Cited

U.S. PATENT DOCUMENTS

| | | | | |
|---|---|---|---|---|
| 5,293,841 | A | 3/1994 | Suhr et al. | |
| 6,764,530 | B2 * | 7/2004 | Iijima | B01D 53/1475 95/183 |
| 7,377,967 | B2 | 5/2008 | Reddy et al. | |
| 7,581,395 | B2 | 9/2009 | Takeuchi et al. | |
| 8,408,006 | B2 | 4/2013 | Li et al. | |
| 2010/0154639 | A1 * | 6/2010 | Perry | B01D 53/1475 95/236 |
| 2011/0226010 | A1 | 9/2011 | Baxter | |
| 2011/0265477 | A1 | 11/2011 | Drouvot et al. | |
| 2012/0067046 | A1 | 3/2012 | Drenik et al. | |
| 2012/0324893 | A1 * | 12/2012 | Hayashi | F01K 7/40 60/691 |
| 2013/0052109 | A1 | 2/2013 | Davis et al. | |
| 2013/0192540 | A1 | 8/2013 | Schüle et al. | |
| 2013/0206010 | A1 * | 8/2013 | Iijima | B01D 53/1475 96/242 |
| 2013/0229012 | A1 | 9/2013 | Jovanovic et al. | |
| 2013/0244305 | A1 | 9/2013 | Versteeg et al. | |
| 2013/0247845 | A1 | 9/2013 | Nakashoji et al. | |
| 2013/0312386 | A1 | 11/2013 | Wirsum et al. | |
| 2014/0060459 | A1 * | 3/2014 | Honjo | F22D 1/003 122/1 R |
| 2014/0208748 | A1 * | 7/2014 | Moser | F01K 13/02 60/645 |
| 2014/0208782 | A1 * | 7/2014 | Joensson | F25B 25/02 62/79 |
| 2016/0195262 | A1 * | 7/2016 | Geiger | F22D 1/003 122/421 |
| 2017/0074504 | A1 * | 3/2017 | Drouvot | F22B 37/025 |
| 2017/0159502 | A1 * | 6/2017 | Polvi | F01K 7/16 |

OTHER PUBLICATIONS

Davison et al., "Performance and costs of power plants with capture and storage of CO2", Energy, Sciencedirect, vol. 32, Issue 7, pp. 1163-1176, Jul. 2007.

Wang et al.,"Application of a low pressure economizer for waste heat recovery from the exhaust flue gas in a 600 MW power plant", Energy, ScienceDirect, vol. 48, Issue 1, pp. 196-202, Dec. 2012.

Perry, R., "Aminosilicone Solvents for Low Cost CO2 Capture," NETL CO2 Capture Technology R&D Meeting, Sep. 13, 2010, Pittsburgh, PA (33 pgs.).

* cited by examiner

METHOD AND APPARATUS TO FACILITATE HEATING FEEDWATER IN A POWER GENERATION SYSTEM

STATEMENT REGARDING FEDERALLY SPONSORED RESEARCH & DEVELOPMENT

This invention was made with Government support under contract number DE-FE0013755 awarded by the Department of Energy (DOE). The Government has certain rights in this invention.

BACKGROUND OF THE INVENTION

The present invention relates generally to power generation systems, and more particularly, to methods and apparatus for preheating feedwater in power generation systems.

At least some known conventional fossil fuel burning power generation systems include a steam cycle power-producing turbine system. Steam turbines are used in known power plants, such as Integrated Gasification Combined Cycle (IGCC) power plants, Natural Gas Combined Cycle (NGCC) power plants, and coal-fired steam cycle power plants. In at least some known power plants, only about 40% of the heat energy contained in the fossil fuel is converted to electricity by a generator. This leaves a large portion of the heat energy wasted in the water cooling towers or other water cooling facilities. At least some known water cooling facilities transfer all of the waste heat in the low pressure exhaust steam to the environment through the vaporization of cooling water.

Additionally, at least some known power plants include a carbon dioxide capture system for separating carbon dioxide from flue gases. Such capture systems may require a large amount of energy provided in the form of steam from the power plant. The extraction of steam from the steam turbine reduces the electricity generation and, thus, the overall efficiency of the power plant. At least some known carbon dioxide capture systems include processes, such as desulphurization, solvent regeneration, and compression, requiring cooling towers that waste a large portion of the heat energy during cooling.

BRIEF DESCRIPTION OF THE INVENTION

In one aspect, a power generation system is provided. The power generation system includes a power generation plant portion including a feedwater heating system configured to channel a feedwater stream and a carbon dioxide capture portion coupled in flow communication with the power generation plant portion. The carbon dioxide capture portion includes a solvent circuit configured to channel a solvent stream through at least a portion of the carbon dioxide capture portion. The carbon dioxide capture portion also includes a heat recovery system coupled in flow communication with the solvent circuit and the feedwater heating system. The heat recovery system is configured to transfer heat energy from the solvent stream to the feedwater stream and to channel the feedwater from the heat recovery system to the feedwater heating system.

In another aspect, a method of heating feedwater for use in a power generation system including a power generation plant portion coupled in flow communication with a carbon dioxide capture portion is provided. The method includes channeling a solvent stream at a first temperature through at least a portion of a solvent circuit in the carbon dioxide capture portion and channeling a feedwater stream at a second lower, temperature through a feedwater heating system coupled in flow communication with the solvent circuit. The method also includes channeling the solvent stream and the feedwater stream through a heat recovery system such that heat energy is transferred from the solvent stream to the feedwater stream to heat the feedwater. The feedwater is then channeled to the feedwater heating system.

In a further aspect, a power generation system is provided. The power generation system includes a power generation plant portion including a boiler configured to generate a flue gas stream and a feedwater heating system coupled in flow communication with the boiler. The feedwater heating system is configured to supply the boiler with a feedwater stream. The power generation plant portion also includes a first heat recovery system coupled in flow communication with the boiler and the feedwater heating system. The first heat recovery system is configured to transfer heat energy from the flue gas stream to the feedwater stream and to channel the feedwater stream from the first heat recovery system to the feedwater heating system. The power generation system also includes a carbon dioxide capture portion coupled in flow communication with the power generation plant portion. The carbon dioxide capture portion includes a solvent circuit configured to channel a solvent stream through at least a portion of the carbon dioxide capture portion. The carbon dioxide capture portion also includes a second heat recovery system coupled in flow communication with the solvent circuit and the feedwater heating system. The second heat recovery system is configured to transfer heat energy from the solvent stream to the feedwater stream and to channel the feedwater from the heat recovery system to the feedwater heating system.

DETAILED DESCRIPTION OF THE INVENTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations are combined and interchanged; such ranges are identified and include all the sub-ranges contained therein unless context or language indicates otherwise.

The power generation systems described herein provide various technological and commercial advantages or improvements over existing power generation systems. The disclosed power generation systems include multiple heat recovery systems that facilitate capturing heat from different locations within the power generation system and transferring the heat energy to boiler feedwater for pre-heating the feedwater before entry into the boiler. As such, the boiler generates more steam with the preheated feedwater while consuming the same amount of fuel, and the steam turbine converts the additional steam into mechanical rotational energy to power a generator and produce additional electricity. Accordingly, the various heat recovery systems described herein facilitate increasing the efficiency of the steam turbine and increasing an amount of electricity generated.

More specifically, the power generation systems described herein include a first heat recovery system downstream of a filtration baghouse and upstream of a flue gas desulfurization unit in a power plant that transfers heat from a flue gas stream to the feedwater. The power generation system includes a second heat recovery system in a carbon dioxide capture portion that transfers heat from a lean solvent stream to the feedwater for use in the power plant. A third heat recovery system in the carbon dioxide capture portion transfers heat from a carbon dioxide stream in a compression system of the carbon dioxide capture portion to the feedwater for use in the power plant. As a result of the above, the power generation systems described herein facilitate improved power plant efficiency, and increased electricity generation.

Figure 1:
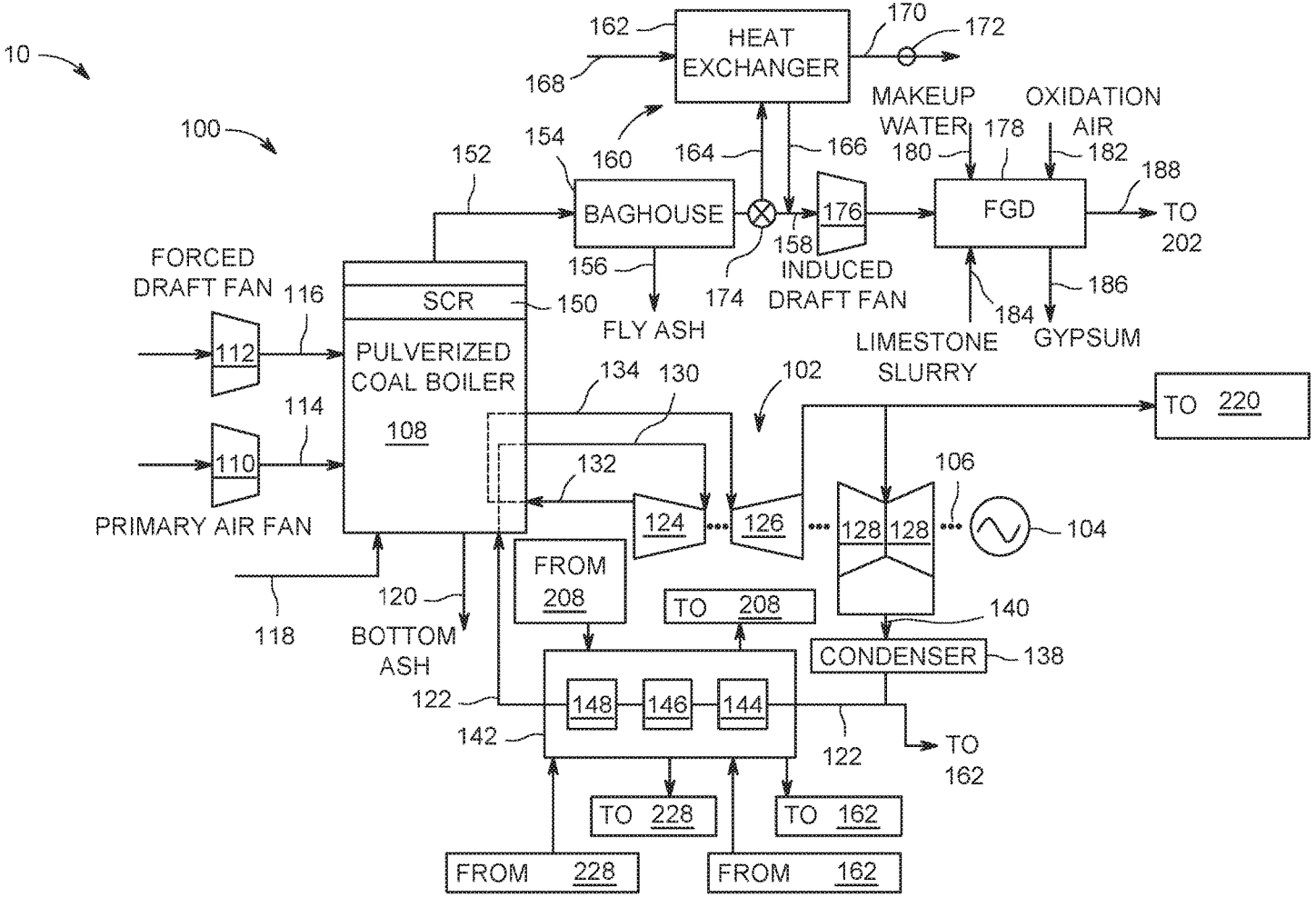
FIG. 1 is a schematic diagram of an exemplary power generation plant portion of a power generation system.

FIG. 1 is a schematic diagram of an exemplary power generation plant portion 100 for use within a power generation system 10. In the exemplary embodiment, power generation plant portion 100 is a coal fired steam cycle power generation plant. Alternatively, power generation plant portion 100 is any power generation plant, such as, but not limited to, an integrated gasification combined-cycle (IGCC), or purely gas turbine driven power plant that facilitates operation of power generation system 10 as described herein.

In the exemplary embodiment, the power generation plant portion 100 includes a steam turbine 102 rotatably coupled to a generator 104 via a rotor shaft 106. Steam turbine 102 is also coupled in flow communication a boiler 108 for providing steam to turbine 102, thereby inducing rotation of turbine 102 and generation of electrical power within generator 104. More specifically, a primary air fan 110 and a forced draft fan 112 provide boiler 108 with air channeled through lines 114 and 116, respectively. Additionally, fuel is channeled into boiler 108 through fuel line 118. In the exemplary embodiment, fuel line 118 channels coal to boiler 108. Alternatively, fuel line 118 channels any hydrocarbon-based fossil fuel product that combusts in the presence of oxygen. When burned, coal produces ash, which is removed from boiler 108 through ash line 120 at the bottom of boiler 108.

Boiler 108 is also provided with high pressure water through a water line 122 from steam turbine 102. More specifically, steam turbine 102 includes a high pressure turbine 124, an intermediate pressure turbine 126, and two (double-flow) low pressure turbines 128. Low pressure turbines 128 channel high pressure water through water line 122 into boiler 108, which boils the water to produce high pressure steam. The high pressure steam is channeled through a high pressure steam line 130 to high pressure turbine 124. A discharge steam flow from high pressure turbine 124 is fed back to boiler 108 via a discharge line 132. Reheated intermediate pressure steam is then fed to intermediate pressure steam turbine 126 via an intermediate pressure steam line 134. Discharge steam from intermediate pressure turbine 126, now at a low pressure is channeled through a discharge line 136 to low pressure turbine 128. Finally, discharge steam from low pressure turbine 128, typically at subatmospheric pressure, is channeled to a condenser 138 via a discharge line 140. Condenser 138 condenses the low pressure steam back into liquid water for channeling through line 122 to boiler 108.

In the exemplary embodiment, condensed cold water within line 122 is channeled to a feedwater heating system 142 for preheating before being channeled back into boiler 108. In the exemplary embodiment, feedwater heating system 142 includes a plurality of feedwater heaters coupled in serial flow communication. More specifically, feedwater heating system 142 includes a first heater 144, a second heater 146, and a third heater 148 for progressively increasing the temperature of the water as it flows from condenser 138 to boiler 108. As such, each heater 144, 146, and 148 is operable to increase the temperature of the water flowing therethrough above the temperature of the water upon entry of a respective heater 144, 146, and 148. Although three heaters 144, 146, and 148 are shown and described, feedwater heating system 142 includes any number of heaters to enable operation of power generation plant portion 100 as described herein. Additionally, power generation plant portion 100 includes any number of water pumps to enable operation of power generation plant portion 100 as described herein.

In the exemplary embodiment, the hydrocarbon or fossil fuel that is burned to heat boiler 108 passes through a selective catalytic reduction (SCR) reactor 150 within boiler 108 to produce a flue gas requiring further downstream processing. The flue gas contains particulates and ash as well as sulfur, heavy metal compounds and other contaminants that require removal from the gas. Specifically, where certain types of coal are burned, the amount of sulfur must be reduced prior to the flue gas being used. Accordingly, in the exemplary embodiment, the flue gas is channeled from boiler 108 through a gas line 152 to a baghouse 154 containing a plurality of filters for removing particulates from the gas stream. In one embodiment, power generation plant portion 100 includes an air cooler (not shown) located in series between boiler 108 and baghouse 154 for cooling the flue gas stream within line 152. Baghouse 154 filters the flue gas stream to remove fly ash, which is channeled through an ash removal line 156 at the bottom of baghouse 154.

The lower particulate flue gas is channeled through a line 158 toward a first heat recovery system 160. In the exemplary embodiment, first heat recovery system 160 includes a heat exchanger 162, a first inlet line 164 for channeling the hot flue gas at a temperature of approximately 143° C. from line 158 to heat exchanger 162, and a first outlet line 166 for channeling the cooled flue gas at a temperature of approximately 50° C. from heat exchanger 162 to line 158. Additionally, first heat recovery system 160 includes a second inlet line 168 for channeling cold feedwater at a temperature within a range of approximately 40-106° C. from one of condenser 138 or line 122 to heat exchanger 162 and a second outlet line 170 for channeling the heated feedwater at a temperature within a range of approximately 61-126° C. to feedwater heating system 142. As such, first heat recovery system 160 recovers heat from the hot flue gas stream passing through a first circuit of heat exchanger 162 and transfers the recovered heat to the feedwater passing through a second circuit of heat exchanger 162 to generate warm feedwater for feedwater heating system 142. Alternatively, first heat recovery system 160 does not include heat exchanger 162 and first inlet and outlet lines 164 and 166 are directly coupled in flow communication with feedwater heating system 142 for channeling the hot flue gas through a suitable one of heaters 144, 146, and 148 based on the temperature of the flue gas.

In the exemplary embodiment, the heated feedwater is channeled through second outlet line 170 to feedwater heating system 142 for additional heating before being channeled through line 122 to boiler 108 for flue gas production. Specifically, the heated feedwater is channeled through second outlet line 170 to a suitable one of heaters 144, 146, and 148 based on the temperature of the feedwater after passing through heat exchanger 162. In the exemplary embodiment, first heat recovery system 160 includes a sensor 172 that determines the temperature of the feedwater after passing through heat exchanger 162 and controls the flow within line 170 to channel the heated feedwater within to one of heaters 144, 146, and 148 having a comparable known temperature. Additionally, in the exemplary embodiment, first heat recovery system 160 includes a bypass system 174 that determines the temperature of the flue gas within line 158 and compares the sensed temperature to a predetermined limit temperature. If the flue gas is below the predetermined temperature, the bypass system 174 channels the flue gas directly through line 158 to an induced fan 176 such that the flue gas bypasses first heat recovery system 160.

Induced fan 176 increases the temperature of the flue gas passing therethrough and provides motive force for the flue gas to pass through a downstream flue gas desulfurization (FGD) unit 178 such that FGD unit 178 is downstream of heat recovery system 160. In the exemplary embodiment, FDG unit 178 is a wet limestone forced oxidation positive pressure absorber non-reheat unit, with wet-stack, and gypsum production. The function of FGD unit 178 is to scrub the flue gas to remove sulfur oxide prior to release to the environment, or entering into a carbon dioxide capture (CDC) system (not shown in FIG. 1), as described in further detail below. FGD unit 178 is coupled in flow communication with a makeup water line 180, an oxidation air line 182, a limestone slurry line 184, and a gypsum line 186. FGD unit 178 receives flue gas from induced fan 176, water from line 180, air from line 182 and slurry from line 184. The air, slurry, and water combine to scrub sulfur oxide from the flue gas and are removed from FGD unit as gypsum through line 186 while the clean flue gas exits FGD unit 178 through a line 188 and is channeled to the CDC system.

Figure 2:
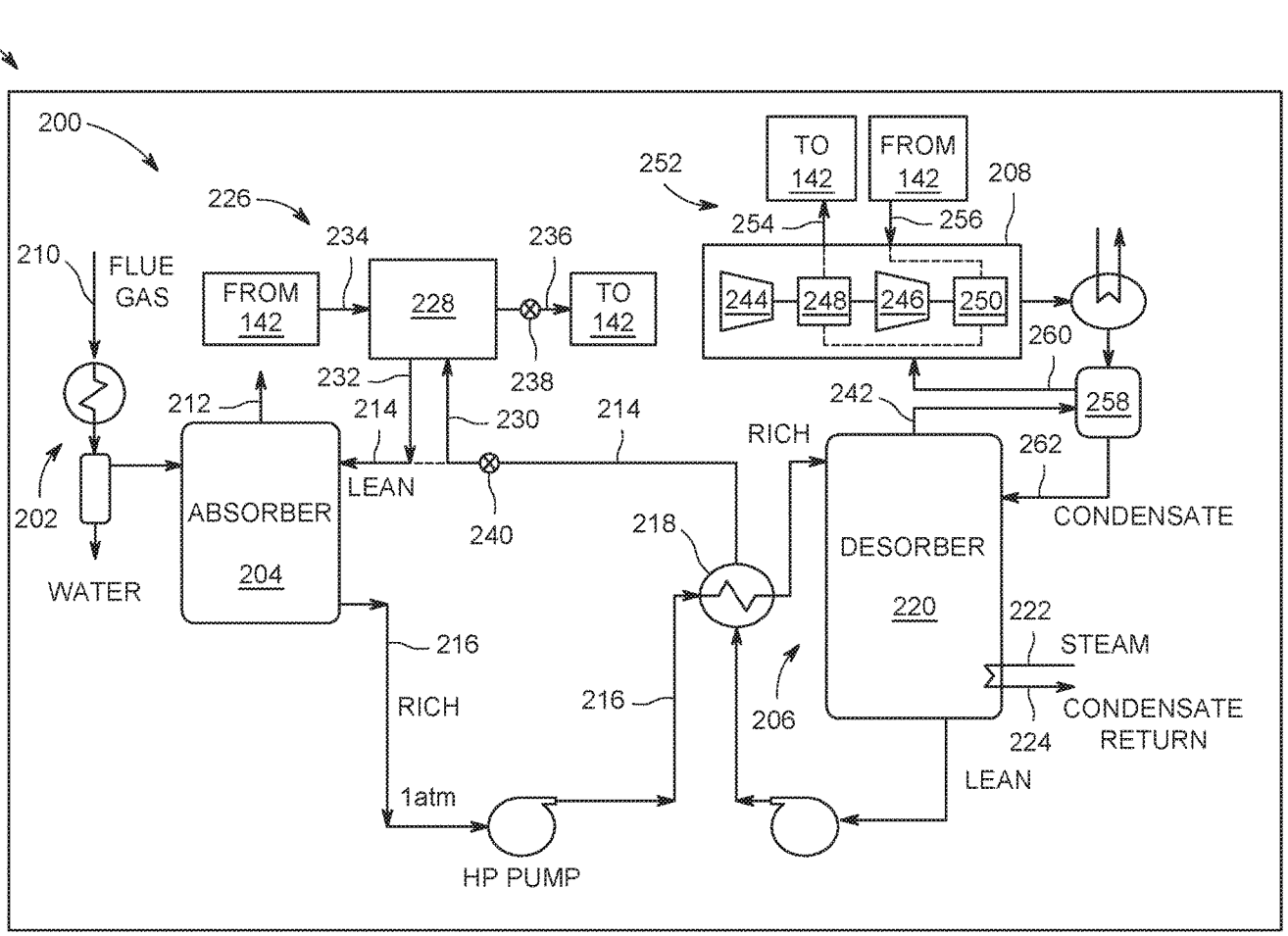
FIG. 2 is a schematic diagram of an exemplary carbon dioxide capture portion that may be used with the power generation plant portion shown in FIG. 1.

FIG. 2 is a schematic diagram of an exemplary carbon dioxide capture (CDC) portion 200 that may be used with power generation plant portion 100 (shown in FIG. 1) to complete power generation system 10. CDC portion 200 is used to remove up to 90 percent of the carbon dioxide in the flue gas exiting FGD unit 178 (shown in FIG. 1), purify the flue gas, and compress it to a supercritical condition.

In the exemplary embodiment, CDC portion 200 includes a sulfur oxide polishing scrubber 202, a carbon dioxide absorber 204, a solvent stripping and reclaiming circuit 206, and a carbon dioxide compression system 208. The flue gas enters CDC portion 200 through an inlet line 210 from line 188 (shown in FIG. 1) downstream of FGD unit 178. Polishing scrubber 202 further removes sulfur oxide from the flue gas to achieve a predetermined concentration within the flue gas to minimize accumulation of hydrogen sulfide. Additionally, polishing scrubber 202 serves as the flue gas cooling system. Cooling water from power generation plant portion 100 is used to reduce the flue gas temperature to below an adiabatic saturation temperature resulting in a reduction of the flue gas moisture content.

The partially cooled flue gas is then channeled to carbon dioxide absorber 204, enters the bottom of carbon dioxide absorber 204, and flows up through carbon dioxide absorber 204 countercurrent to a stream of lean aminosilicone solvent. Approximately 90 percent of the carbon dioxide in the fuel gas is absorbed into the lean solvent, and the remainder leaves the top of carbon dioxide absorber 204 through an outlet line 212 and flows into a water wash section (not shown) of CDC portion 200. The lean solvent enters the top of carbon dioxide absorber 204 through an inlet line 214, absorbs the carbon dioxide from the flue gas and leaves the bottom of carbon dioxide absorber 204 with the absorbed carbon dioxide through a rich solvent outlet line 216.

In the exemplary embodiment, solvent stripping and reclaiming circuit 206 includes a carbon dioxide rich solvent line 216, carbon dioxide lean solvent line 214, a solvent heat exchanger 218, and a carbon dioxide desorber 220. In operation, cold carbon dioxide rich solvent is channeled through line 216 from absorber 204 to desorber 220. Similarly, hot carbon dioxide lean solvent is channeled through line 214 from desorber 220 to absorber 204. In the exemplary embodiment, lines 214 and 216 both cross through solvent heat exchanger 218 such that the rich solvent from the bottom of absorber 204 is preheated by the lean solvent from the desorber 220 in the solvent heat exchanger 218.

A portion of the steam drawn from intermediate pressure turbine 126 via line 136 (both shown in FIG. 1) is redirected to a reboiler portion of desorber 220 in CDC portion 200 via a line 222. This lower pressure steam is used to provide the necessary heat to the reboiler of desorber 220 for the regeneration of solvent used for post combustion carbon dioxide capture. After transferring heat inside the reboiler to the solvent, the low pressure steam becomes warm water which is then fed to feedwater heating system 142 (shown in FIG. 1) via a line 224. The uncondensed carbon dioxide rich gas is then delivered to compression system 208, as described in further detail below.

In the exemplary embodiment, circuit 206 also includes a second heat recovery system 226 that also provides additional heat to the feedwater before entry into boiler 108 (shown in FIG. 1). More specifically, second heat recovery system 226 is positioned along hot lean solvent line 214 and includes a heat exchanger 228, a first inlet line 230 for channeling the hot lean solvent at a temperature within a range of approximately 52-72° C. from line 214 to heat exchanger 228, and a first outlet line 232 for channeling the cooled lean solvent at a temperature within a range of approximately 30-50° C. from heat exchanger 228 back to line 214 before the lean solvent enters absorber 204. Additionally, second heat recovery system 226 includes a second inlet line 234 for channeling cold feedwater at a temperature within a range of approximately 30-50° C. from one of condenser 138 or line 122 (both shown in FIG. 1) in power generation plant portion 100 to heat exchanger 228 and a second outlet line 236 for channeling the heated feedwater at a temperature within a range of approximately 78-98° C. to feedwater heating system 142. As such, second heat recovery system 226 recovers heat from the hot lean solvent passing through a first circuit of heat exchanger 228 and transfers the recovered heat to the feedwater passing through a second circuit of heat exchanger 228 to generate warm feedwater for feedwater heating system 142. Alternatively, second heat recovery system 226 does not include heat exchanger 228 and first inlet and outlet lines 232 and 234 are directly coupled in flow communication with feedwater heating system 142 for channeling the hot lean solvent through a suitable one of heaters 144, 146, and 148 (all shown in FIG. 1) based on the temperature of the lean solvent.

In the exemplary embodiment, the heated feedwater is channeled through second outlet line 236 to feedwater heating system 142 for additional heating before being channeled through line 122 to boiler 108 (shown in FIG. 1) for steam production. Specifically, the heated feedwater is channeled through second outlet line 236 to a suitable one of heaters 144, 146, and 148 based on the temperature of the feedwater after passing through heat exchanger 228. In the exemplary embodiment, second heat recovery system 226 includes a sensor 238 that determines the temperature of the feedwater after passing through heat exchanger 228 and controls the flow within line 236 to channel the heated feedwater within to one of heaters 144, 146, and 148 having a comparable known temperature. Additionally, in the exemplary embodiment, second heat recovery system 226 includes a bypass system 240 that determines the temperature of the hot lean solvent within lean solvent line 214 and compares the sensed temperature to a predetermined limit temperature. If the lean solvent is below the predetermined temperature, bypass system 240 channels the lean solvent directly through line 214 to absorber 204 such that the lean solvent bypasses second heat recovery system 226.

As described above, compression system 208 is downstream of desorber 220 in CDC portion 200. More specifically, desorber 220 separates the solvent from the entrained carbon dioxide and channels the uncondensed carbon dioxide through a CO2 line 242, through a separation unit as described below, to compression system 208. In the exemplary embodiment, compression system 208 a plurality of compression stages, including a first compressor 244 and a second compressor 246, and a plurality of heat exchangers positioned between adjacent compressors, including a first heat exchanger 248 between compressors 244 and 246 and a second heat exchanger 250 downstream from second compressor 246. Although only two stages of compression are shown and described herein, compression system 208 includes any number of compression stages to enable operation of CDC portion 200 as described herein.

In operation, the carbon dioxide enters compression system 208 via line 260 and is channeled through first compressor 244, first heat exchanger 248, second compressor 246, and second heat exchanger 250 in series to pressurize the carbon dioxide. Each heat exchanger 248 and 250 operates to cool the carbon dioxide flowing therethrough to approximately the same exit temperature as the carbon dioxide exit temperature in the other heat exchanger before channeling the carbon dioxide from CDC portion through an outlet line to a storage facility or for further processing.

In the exemplary embodiment, a third heat recovery system 252 is coupled in flow communication with compression system 208. Third heat recovery system 252 includes an inlet line 256 for channeling cold feedwater at a temperature within a range of approximately 40-88° C. from one of condenser 138 or line 122 to compression system 208 and an outlet line 254 for channeling the heated feedwater at a temperature within a range of approximately 58-106° C. to feedwater heating system 142. Upon entry to compression system 208 via line 256, the cold feedwater is channeled through at least one of heat exchangers 248 and 250 to recover heat from the hot compressed carbon dioxide passing through a first circuit of heat exchanger 248 and/or 250 and transfer the recovered heat to the feedwater passing through a second circuit of heat exchanger 248 and/or 250 to generate warm feedwater for feedwater heating system 142. In one embodiment, the feedwater is channeled through the one heat exchanger 248 or 250 that transfers the most heat to the feedwater flowing through the second circuit thereof. In another embodiment, the feedwater is channeled through any number of heat exchangers 248 and 250 in compression system 208, while bypassing compressors 244 and 246, such that heat from the compressed carbon dioxide is being transferred to the feedwater (as shown in dashed line in FIG. 2).

In the exemplary embodiment, the heated feedwater is channeled through outlet line 254 to feedwater heating system 142 for additional heating before being channeled through line 122 to boiler 108 for flue gas production. Specifically, the heated feedwater is channeled through outlet line 254 to a suitable one of heaters 144, 146, and 148 based on the temperature of the feedwater after passing through heat exchangers 248 and 250.

CDC portion 200 also includes a carbon dioxide separation unit 258 upstream of compression system 208. Separation unit 258 receives carbon dioxide from desorber 242, and more specifically, from line 242, and further cools the gases before separating gaseous carbon dioxide from liquid condensate. The gaseous carbon dioxide is channeled to compression system 208 through an outlet line 260 for further processing. The condensate is channeled through a condensate line 262 to desorber 220 to enable removal of carbon dioxide from the rich solvent entering desorber 220.

In the exemplary embodiment, a power generation system 10 includes power generation plant portion 100 and carbon dioxide capture portion 200. Power generation plant portion 100 includes first heat recovery system 160, while carbon dioxide capture portion 200 includes second heat recovery system 226 and third heat recovery system 252. In operation of power generation system 10, any combination of heat recovery systems 160, 226, and 252 are used to preheat feedwater. More specifically, any of heat recovery systems 160, 226, and 252 may be used independently to the exclusion of the other heat recovery systems 160, 226, and 252 or any two of heat recovery systems 160, 226, and 252 may be used to the exclusion of the remaining heat recovery systems 160, 226, and 252. Additionally, all three heat recovery systems 160, 226, and 252 may be used simultaneously. The determination of which combination of heat recovery systems 160, 226, and 252 are used is based on the temperatures of the feedwater and the temperature of the fluid that transfers heat to the feedwater.

Exemplary embodiments of various heat recovery systems for use in a power generation system are described in detail above. The power generation system includes a power generation plant including a feedwater heating system configured to channel a feedwater stream and a carbon dioxide capture portion coupled in flow communication with the power generation plant. The carbon dioxide capture portion includes a solvent circuit configured to channel a solvent stream through at least a portion of the carbon dioxide capture portion. The carbon dioxide capture portion also includes a heat recovery system coupled in flow communication with the solvent circuit and the feedwater heating system. The heat recovery system is configured to transfer heat energy from the solvent stream to the feedwater stream and to channel the heated feedwater from the heat recovery system to the feedwater heating system.

An exemplary technical effect of the methods, systems, and apparatus described herein includes at least one of: (a) transferring heat from a flue gas stream to feedwater downstream of a filtration baghouse and upstream of an induced fan in a power plant; (b) transferring heat from a lean solvent stream in a carbon dioxide capture portion to feedwater for use in a power plant; (c) transferring heat from a carbon dioxide stream in a compression system of a carbon dioxide capture portion to feedwater for use in a power plant; (d) increasing efficiency of the power plant by reducing the amount of wasted heat energy and by channeling less steam from the steam turbine to heat the feedwater.

Exemplary embodiments of methods, systems, and apparatus for heat recovery systems are not limited to the specific embodiments described herein, but rather, components of systems and steps of the methods may be utilized independently and separately from other components and steps described herein. For example, the methods may also be used in combination with other power plant configurations, and are not limited to practice with only the coal fired power plant system and methods as described herein. Rather, the exemplary embodiment can be implemented and utilized in connection with many other applications, equipment, and systems that may benefit from the advantages described herein.

Although specific features of various embodiments of the disclosure may be shown in some drawings and not in others, this is for convenience only. In accordance with the principles of the disclosure, any feature of a drawing may be referenced and claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A feedwater system comprising:

a plurality of feedwater heaters comprising:

a first feedwater heater;

a second feedwater heater downstream of and in fluid communication with the first feedwater heater; and a third feedwater heater downstream of and in fluid communication with the second feedwater heater; and a plurality of heat sources comprising:

a hot flue gas;

a hot lean solvent; and hot compressed carbon dioxide;

wherein each heat source of the plurality of heat sources acts as a heat source for a respective one of the plurality of feedwater heaters, such that the hot flue gas is channeled through only one of the first, the second and the third feedwater heaters, the hot lean solvent is channeled through only another of the first, the second and the third feedwater heaters, and the hot compressed carbon dioxide is only channeled through the remaining one of the first, the second and the third feedwater heaters.

2. The feedwater system of claim 1, wherein the hot lean solvent is selectively channeled through the respective one of the plurality of feedwater heaters based on the temperature of the hot lean solvent such that the feedwater system progressively increases the temperature of the feedwater.

3. The feedwater system of claim 1, wherein the hot flue gas is channeled to the first feedwater heater.

4. The feedwater system of claim 1, wherein each of the hot flue gas, the hot lean solvent, and the hot compressed carbon dioxide flow from a carbon capture system.

5. The feedwater system of claim 4, wherein the hot lean solvent comprises a lean aminosilicone solvent.

6. The feedwater system of claim 4, wherein the hot flue gas flows from an extraction point of the carbon capture system, the extraction point being downstream of a filtration baghouse and upstream of an inducted draft fan.

7. The feedwater system of claim 1, wherein the hot lean solvent is channeled to the first feedwater heater.

8. The feedwater system of claim 7, wherein the hot compressed carbon dioxide is channeled to the second feedwater heater.

9. The feedwater system of claim 8, wherein the hot flue gas is channeled to the third feedwater heater.

10. The feedwater system of claim 9, wherein the hot lean solvent comprises a lean aminosilicone solvent, and wherein the hot flue gas flows from an extraction point of a carbon capture system, the extraction point being downstream of a filtration baghouse and upstream of an inducted draft fan.

11. A power plant comprising:

a plurality of feedwater heaters comprising:

a first feedwater heater;

a second feedwater heater downstream of and in fluid communication with the first feedwater heater; and a third feedwater heater downstream of and in fluid communication with the second feedwater heater; and a plurality of heat sources comprising:

a hot flue gas;

a hot lean solvent; and hot compressed carbon dioxide;

wherein each heat source of the plurality of heat sources acts as a heat source for a respective one of the plurality of feedwater heaters, such that the hot flue gas is channeled through only one of the first, the second and the third feedwater heaters, the hot lean solvent is channeled through only another of the first, the second and the third feedwater heaters, and the hot compressed carbon dioxide is only channeled through the remaining one of the first, the second and the third feedwater heaters.

12. The feedwater system of claim 11, wherein the hot lean solvent comprises a lean aminosilicone solvent.

* * * * *